US009581337B2

(12) United States Patent
Heinonen

(10) Patent No.: US 9,581,337 B2
(45) Date of Patent: Feb. 28, 2017

(54) ARRANGEMENT IN THE VENTILATION OF A KITCHEN APPLIANCE

(75) Inventor: Antero Heinonen, Palokka (FI)

(73) Assignee: Oy Lindab Ab, Espoo (FI)

( * ) Notice: Subject to any disclaimer, the term of this patent is extended or adjusted under 35 U.S.C. 154(b) by 1882 days.

(21) Appl. No.: 10/578,851

(22) PCT Filed: Nov. 11, 2004

(86) PCT No.: PCT/FI2004/050161

§ 371 (c)(1),
(2), (4) Date: May 10, 2006

(87) PCT Pub. No.: WO2005/045323

PCT Pub. Date: May 19, 2005

(65) Prior Publication Data

US 2007/0084459 A1 Apr. 19, 2007

(30) Foreign Application Priority Data

Nov. 11, 2003 (FI) ..... 20035203

(51) Int. Cl.
*F24C 15/20* (2006.01)
*F23J 11/00* (2006.01)

(52) U.S. Cl.
CPC ..... *F24C 15/20* (2013.01); *F24C 15/2021* (2013.01); *F23J 11/00* (2013.01)

(58) Field of Classification Search
CPC .... F24C 15/00; F24C 15/20121; F21C 15/08; F23J 11/00
USPC ..... 126/299 R, 299 D, 299 E; 431/181
See application file for complete search history.

(56) References Cited

U.S. PATENT DOCUMENTS 4,014,381 A * 3/1977 Clark ..... 165/216
4,036,994 A 7/1977 Ear
4,038,912 A * 8/1977 Kuechler ..... F24C 15/20 126/299 D
4,117,833 A * 10/1978 Mueller ..... 126/299 D
4,124,021 A * 11/1978 Molitor ..... 126/299 E
4,235,220 A 11/1980 Hepner
4,363,642 A 12/1982 Stahl
4,407,266 A * 10/1983 Molitor ..... 126/299 D
4,484,563 A * 11/1984 Fritz ..... F24C 15/20 126/299 D
5,292,353 A 3/1994 Kaufman et al.
6,170,480 B1 * 1/2001 Melink et al. ..... 126/299 R
(Continued)

FOREIGN PATENT DOCUMENTS

EP 0762061 3/1997

*Primary Examiner* — Gregory Huson
*Assistant Examiner* — Nikhil Mashruwala
(74) *Attorney, Agent, or Firm* — Fildes & Outland, P.C.

(57) ABSTRACT

The invention relates to an arrangement in the ventilation of a kitchen appliance. The arrangement is arranged to be connected to a ventilation system. The arrangement includes at least one hood (10), which is intended to be installed above the kitchen appliance (11). There is an exhaust-air connection (27) in each hood (10), for connecting the hood (10) to the exhaust-air duct (12) belonging to the ventilation system. The arrangement also includes a separator (15), for separating grease form the exhaust air. The arrangement further includes a cell (14), which is arranged after the hood (10) and is separate from the hood (10), and to which a separator (15) is fitted, and which is connected to the exhaust-air duct (12).

11 Claims, 4 Drawing Sheets

(56) References Cited

U.S. PATENT DOCUMENTS

Figure 1:
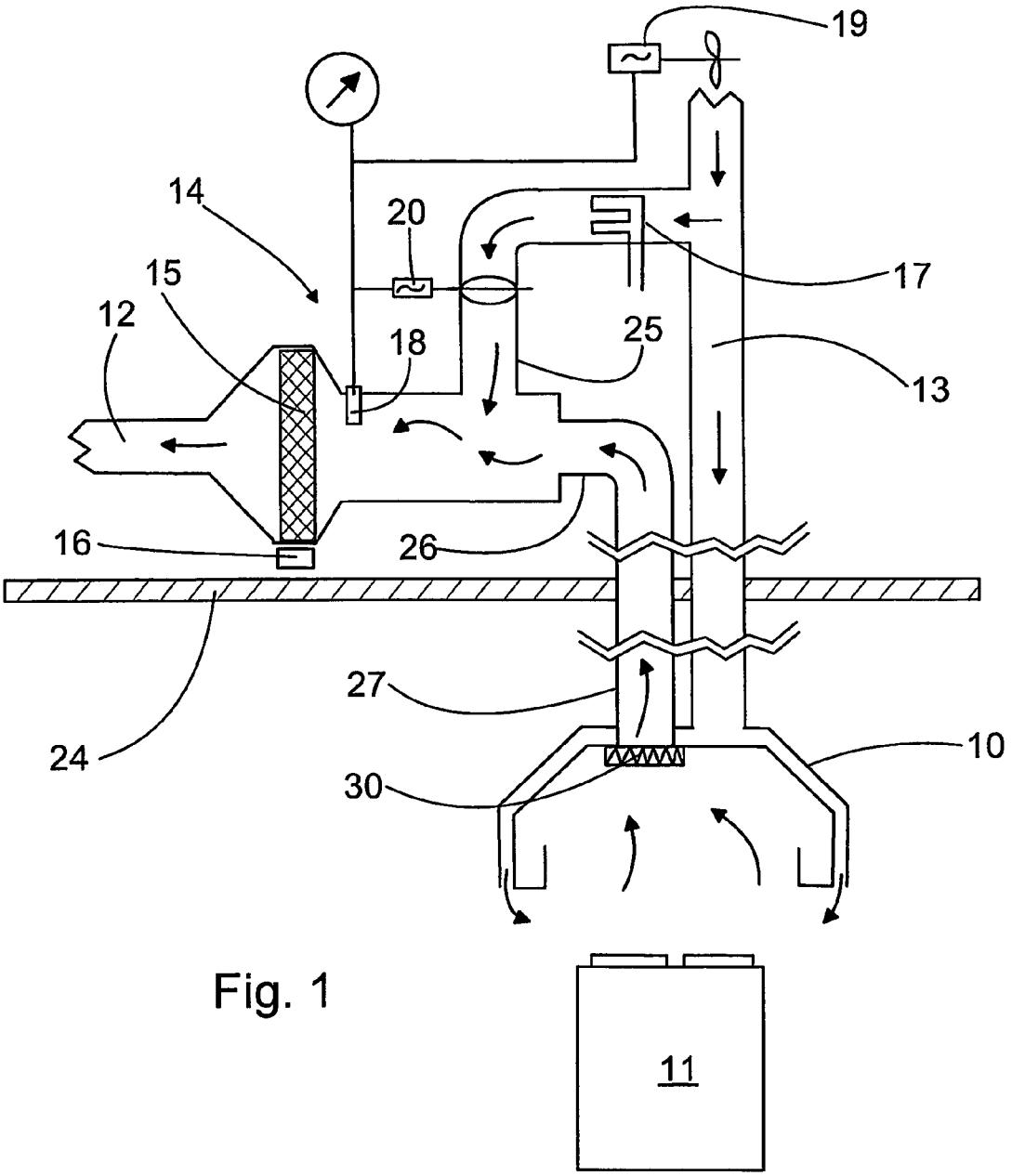

| | | | | |
|---|---|---|---|---|
| 6,669,547 | B2 * | 12/2003 | Liu | B08B 15/002 126/299 F |
| 2007/0068509 | A1 * | 3/2007 | Bagwell et al. | 126/299 D |

* cited by examiner

ARRANGEMENT IN THE VENTILATION OF A KITCHEN APPLIANCE

The present invention relates to an arrangement in the ventilation of a kitchen appliance, which arrangement is arranged to be connected to a ventilation system, and which arrangement includes at least one hood, which is intended to be installed above the kitchen appliance, an exhaust-air connection in each hood, for connecting the hood to the exhaust-air duct belonging to the ventilation system, and a separator, for separating grease form the exhaust air.

In food preparation, rape-seed, olive, soya, maize, and sunflower oils, for example, are used. The greatest emissions are caused by deep-frying and especially by grilling. For example, when making hamburgers with a gas grill, about two thousand grammes of vapour are created for each hundred kilograms of food. At the same time about three thousands grammes of particles are created. The biggest of the grease particles created in food preparation can be separated using a mechanical separator. However, a large proportion of the grease leaving during food preparation is in the form of vapour. Due to the large number of grease emissions, it is important to clean the exhaust-air duct to ensure fire safety. For example, in the kitchens of hotels and restaurants, in which large amounts of food are prepared, the dirtying of ventilation ducts is a significant problem. Some of the vaporized grease collects in the exhaust-air duct after the separator, where it is difficult to remove. The dirtying is further exacerbated by separators and filters that are unsuitable for the application, or wrongly installed or operated. In some cases, the separator is entirely omitted. In practice, grease accumulations even more than 25-mm thick have been found in exhaust air ducts. In the case of continuous operation, cleaning is recommended three times a year, or preferably even more frequently. In problem cases, the exhaust-air ducts dirty even more rapidly and, in addition, cleaning is difficult, especially if the grease has been able to spread over a long distance. The problem is worsened by making the ventilation ducts, and particularly the exhaust-air ducts from spiral-seam pipes, which can leak grease into the structures below them.

In principle, the ideal situation would be to remove the grease and other particles from the exhaust air, in order to prevent the dirtying of the ventilation ducts. This would improve fire safety and reduce local dirtying of the outdoor air. Thus, for example, an exhaust-air hood is usually fitted above kitchen appliances, to separate especially grease and other impurities from the exhaust air. The hood is intended to prevent the impurities, heat, and moisture arising from the food preparation process from spreading into the working zone. The air is generally exhausted through a separator in the hood, which is intended to prevent the grease particles from travelling into the exhaust duct. The kitchen appliance is, for example, a kitchen stove, a deep-fat fryer, or a grill. Usually, the hood is thus connected to a normal exhaust-air duct. One known hood has a separator set at a slant, through which the exhaust air is led. In addition, replacement air nozzles are often connected to the hood, through which cold intake air is led, which also cools the hood. The intake air can also be used to guide the dirty air towards the separator. The intake air is also used to cool the separator, which is thus also intended to condense the grease in the exhaust air, in order to remove it. There can also be a washing-fluid spray in the separator, which is used to remove the impurities from the surface of the grease separator.

Existing separators are designed to remove mainly grease that is in a solid form. However, up to 60-70% of the grease emissions from kitchen appliances are in the form of vapour. The grease in the form of vapour passes through the separators and most of the grease solidifies only once it reaches the ventilation duct, where it collects. Even if the separators presently in use could remove all the particles in solid form, their grease-separation ability would be at most 30-40% of the total amount of grease. In addition, the effect of existing separators drops rapidly as the size of the particles decreases.

In practice however, the hood and the separator clearly heat up, despite the replacement air, thus preventing, or at least clearly reducing the condensation of the grease. The greasy air then travels farther into the exhaust-air duct, where the grease finally condenses. In practice, the entire exhaust-air duct becomes dirty and the grease may spread to the structure, which considerably increases the fire load. The grease also blocks possible noise attenuators and may spread through the fan to the roof of the building and from there to the environment. The problem is further aggravated by the hood being installed close to the kitchen appliance and the continuous operation of the kitchen appliance, so that the hood and separator remain hot (60-70°) the whole time. Known separators are generally too small relative to the amount of air. In addition, a separate hood containing a separator must be installed for each kitchen appliance, which increases the purchase and operating costs.

The invention is intended to create a new type of arrangement in the ventilation of a kitchen appliance, which is simpler and more effective than previously and which can be used to avoid the drawbacks of the prior art. The characteristic features of the arrangement according to the invention are stated in the accompanying Claims. In the arrangement according to the invention, the separator is located in a new and surprising manner. In addition, grease and particles are separated from the exhaust air more effectively than previously. Now the grease in the form of vapour is also separated. In addition to the effective separation ability, a simpler hood than before can be used, which among other things facilitates the positioning of kitchen appliances. On the other hand, the arrangement can also be fitted in connection with existing hoods, so that problem locations can be easily eliminated. The effect of the arrangement can also be easily increased as required, in order to create a suitable arrangement for each application.

Figure 2:
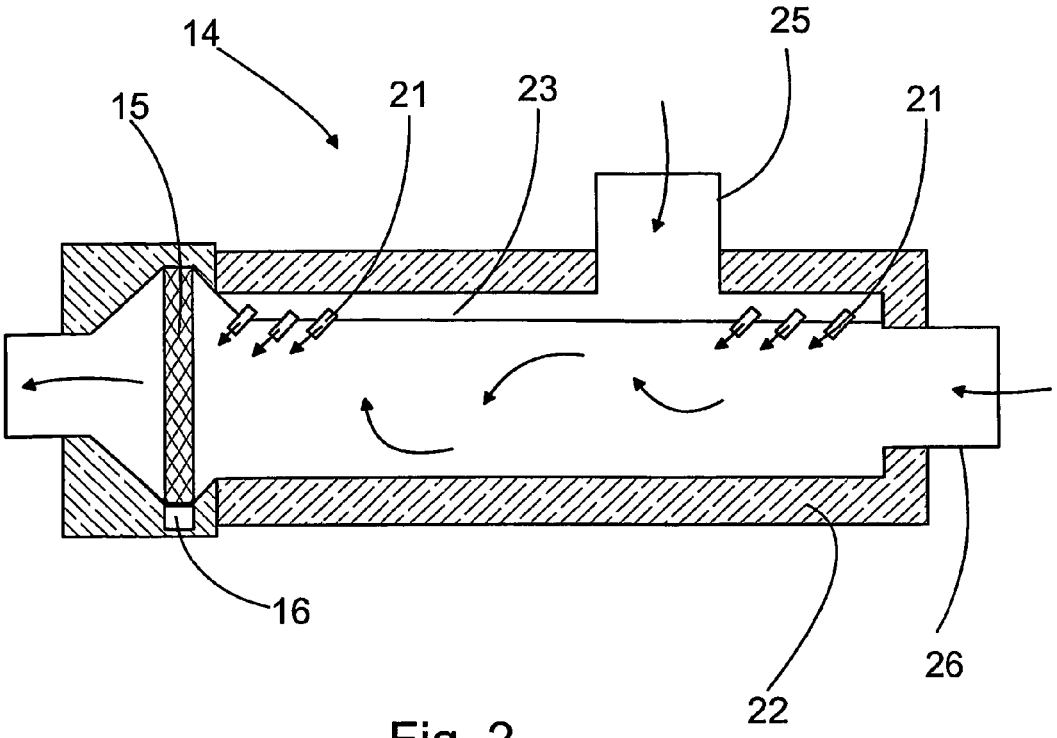
Figure 3:
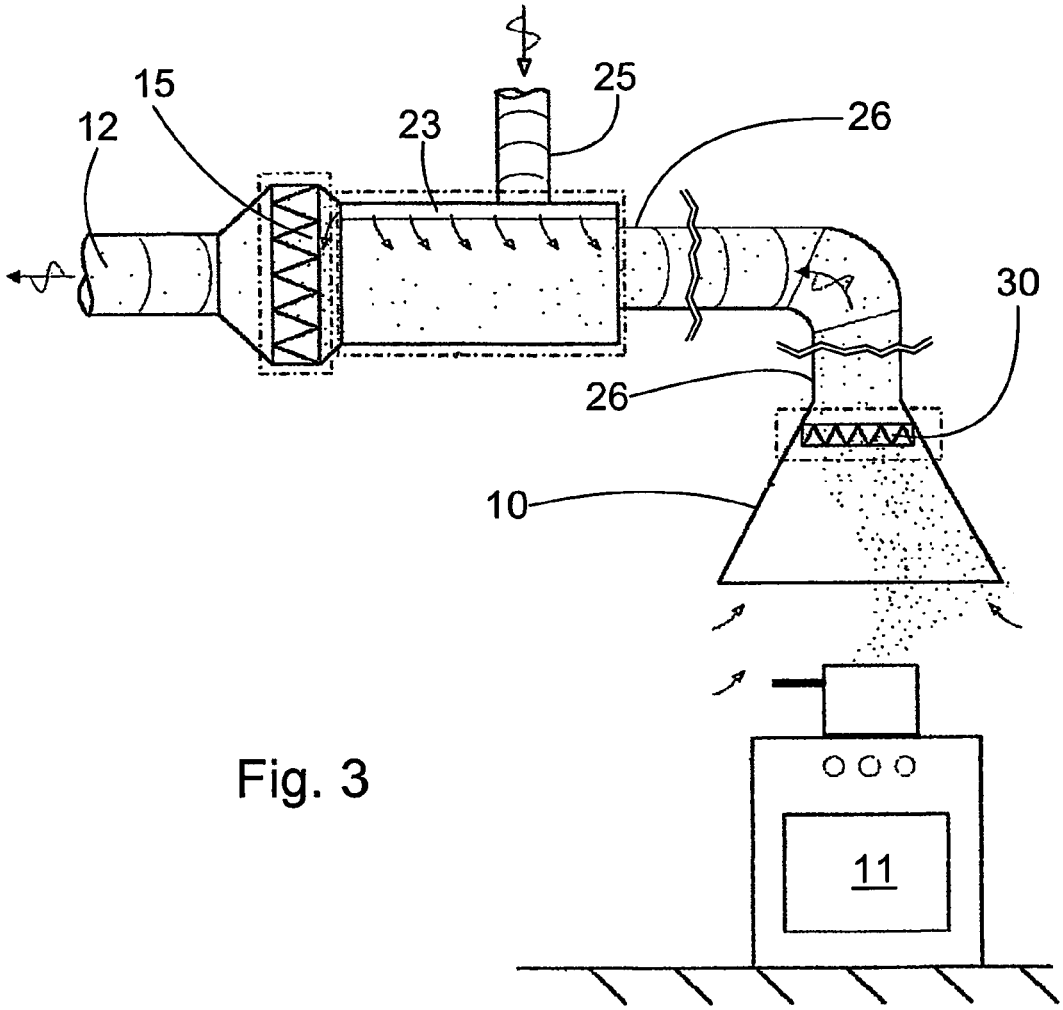
Figure 4:
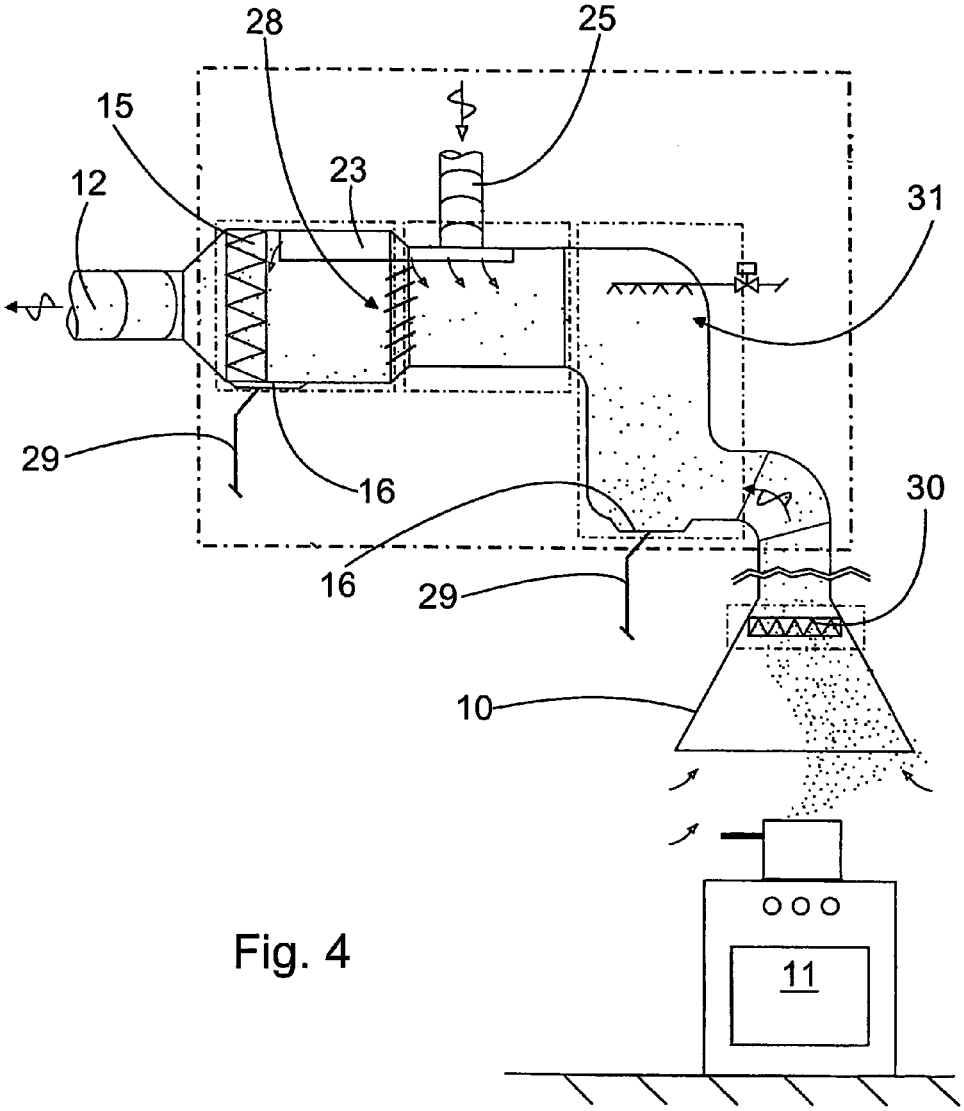

In the following, the invention is examined in detail with reference to the accompanying drawings showing some embodiments of the invention, in which FIG. 1 shows a schematic diagram of the operation of the arrangement according to the invention, FIG. 2 shows a cross-section of part of the arrangement, FIG. 3 shows a schematic diagram of a second embodiment of the arrangement according to the invention, FIG. 4 shows a schematic diagram of a third embodiment of the arrangement according to the invention.

The figures show schematic diagrams of the arrangement according to the invention in the ventilation of a kitchen appliance. In practice, the arrangement forms part of the ventilation system, to which the arrangement is designed to be connected. The ventilation system includes at least an exhaust-air duct, in which there is suitable machinery for creating a sufficient airflow. The ventilation system may also include mechanical intake air blowing, which can be exploited in the arrangement according to the invention. The figures show only part of the ventilation system, the construction of which can vary in different applications.

The arrangement includes at least one hood 10, which is intended to be installed above a kitchen appliance 11. The hood is used, among other things, to prevent grease emissions from spreading into the surroundings of the kitchen appliance. In addition, the hood 10 has an exhaust-air connection 27, for connecting the hood 10 to an exhaust-air duct 12 forming part of the ventilation system. Thus, a continuous suction is created into the hood. The arrangement further includes a separator 15, particularly for separating grease from the exhaust air. At the same time, other impurities are also separated, so that the exhaust air is as clean as possible after the separator. The same reference numbers are used for parts that are functionally similar.

The arrangement according to the invention further includes a cell 14 arranged after the hood 10. In addition, the cell 14 is separate from the hood 10 and the separator 15 is fitted to it. The cell 14 is also connected to the exhaust-air duct 12. In other words, the cell 14 is a component in the ventilation system, between the hood 10 and the exhaust-air duct 12. The arrangement in question is used to avoid the disadvantageous heating of the separator and the reduction in separation ability. In addition, if required a suitable motion is introduced to the exhaust air, which promotes the separation of the vaporous grease. According to the invention, the separate cell is used to limit the area in which the grease condenses. This avoids the dirtying of the exhaust-air ducts. Conditions favouring the separation of the grease can also be created in the cell, which is difficult using the prior art, and often indeed impossible.

The cell 14 according to the invention is an elongated structure, with the separator 15 fitted to one end of it. It is then possible to maximize the time used to separate the grease, without unnecessary pressure losses. The cell 14 also includes a connection 26 for leading the exhaust air from the hood 10 to the cell 14. In practice, the connection is connected to the part of the exhaust-air duct that comes from the hood. According to the invention, the connection is fitted to the opposite end of the cell 14 to the separator 15. The use of this arrangement permits the most effective exploitation of the entire length of the cell 14. In FIG. 1, the cell 14 is installed below the ceiling 24. In addition, the distance between the hood 10 and the cell 14 can vary in different applications.

Usually, the hood is installed on the ceiling above the kitchen appliance. The elongated cell according to the invention can be easily fitted essentially horizontally relative to its longitudinal axis. This reduces the installation space required in the height direction and facilitates the collection of grease. It is also easy to support the cell horizontally.

In certain cases, the grease is separated using only the separator fitted to the cell. In order to ensure separation, or the increase the effect of the arrangement, an intake-air connection 25 can be fitted to the cell 14. The intake-air connection 25 is connected, for example, to the intake-air duct 13 belonging to the ventilation system, in order to lead intake air to the cell 14. Using intake air, it is easy to reduce the temperature of the exhaust air, which will further increase the effect of the separator and promote the formation of droplets of vaporized grease. If it is given a suitable direction, the intake airflow will also favourably alter the flow of exhaust air in the cell, which will, for its part, accelerate the condensation of the grease. FIGS. 2-4 show a distribution duct 23 belonging to the cell 14, through which the intake air is fed into the exhaust air. The arrows show the flow of the intake air from the distribution duct 23. FIG. 2 shows additionally nozzle elements 21 connected to the distribution duct 23, so that the intake air can, for example, be directed and boosted, in order to increase the efficiency of the mixing. The intake air can even be fed counter to the flow of the exhaust air (FIGS. 3 and 4).

Instead of an intake-air duct, it is also possible to use a separate duct, through which outdoor air, for example, is led to the cell. The operation of the ventilation system will then remain undisturbed and the operating costs as low as possible. According to the invention, means for regulating the velocity, quantity, and/or temperature of the intake air as desired in the cell 14, can be fitted in connection with the intake-air connection 25. In this case, the means in question include a heat exchanger 17, a temperature sensor 18, a motor 19, and a damper 20. Thus, the intake air is used to create advantageous vortices in the exhaust air, which accelerates the cooling of the exhaust air and the formation of droplets. Various baffle elements can also be used to guide the flow. In FIG. 4, the baffle elements 28 are used to guide the exhaust air to the walls of the cell 14 already before the separator 15, which accelerates the separation of the grease. The grease condensing on the walls and the separator flows down by gravity into grease cups 16.

If necessary, intake-air cooling is also used with a suitable heat exchanger 17. In this case, there is additionally a heat sensor 18 in the cell 14, on the basis of which the quantity of intake air is regulated by altering, for example, the speed of rotation of the motor 18, or the position of the damper 20. Other sensors too, such as flow-velocity sensors, can also be used to control the quantity of intake air. Beneath the separator 15 there is also a grease cup 16, into which the condensed grease and other impurities flow. Drainage 29 can also be connected to the grease cup 16, so that the grease will leave the cell automatically 14 (FIG. 4).

The exhaust air can also be cooled, for example, using a water mist. For this purpose, there are washing elements 31 in the cell for distributing washing liquid to the separator 15 and/or the exhaust air. In the embodiment of FIG. 4, the washing liquid used is water and the washing elements are advantageously arranged as a separate totality before the actual cell. Thus, it is possible to event retrofit washing elements to the cell. For example, the water mist effectively binds the vaporous grease and at the same time reduces the temperature of the exhaust air. In the embodiments of FIGS. 3 and 4, a pre-separator 30, which is used to remove the large particles from the exhaust air, is fitted to the hood 10.

The cell is dimensioned case-specifically and various possibilities to improve the separation efficiency are described above. The width of the cell is generally 1,1-2,0, preferably 1,2-1,8 times that of the connection. The width of the cell is thus preferably larger than the diameter of the exhaust-air duct, in which case the velocity of the air will drop when it reaches the cell, which will facilitate condensation. The velocity can be further decreased by making the cell so that it widens. For example, the velocity of the airflow when it leaves the hood can be 8 m/s. Thanks to the cell according to the invention, the velocity can be made to drop, for example, to a value of 3-4 m/s. The cell can also be arranged to be in several parts (FIGS. 2 and 4). This will make the installation and maintenance of the cell easy. In practice, a cell that is wider than the ventilation duct forms a mixing chamber, in which the exhaust air and the intake air are mixed to effectively separate the grease. Other ways too of shaping the cell will lead to a reduction in the air velocity, which will improve the separation efficiency.

The mixing of the airflows and the reduction of the flow velocity requires a certain amount of time. Thus, the length of the cell according to the invention is 2-6 times, preferably 3-5 times the width of the cell. The size of the cell will then remain reasonable while still, however, maintaining a sufficient separation effect. For example, the length of a cell according to the invention, connected to a 200-300-mm-diameter exhaust-air duct, would be about 2000 mm. Correspondingly, the height of the cell would be about 600 mm and its width 800 mm. In practice, the cell is dimensioned mainly according to the exhaust-air duct. Preferably the length and width of the cell are varied. Thus the height of the cell will remain sufficiently small from the point of view of installation. A sufficient delay time can also be achieved by arranging the cubic capacity of the cell 14 to be at least 10% of the minute volume of the exhaust airflow.

The cell is preferably a sheet-structured box, being thus light and easily also installed later. It is also easy to create the distribution duct described above to a sheet-structured box. This cell can also be opened and the separator removed for cleaning. FIG. 2 shows one ready-to-install cell, which is, in addition, completely surrounded by insulation 22. Several hoods can be connected to a single cell, but it is also possible to arrange a cell for each hood and kitchen appliance. The size of the cell will then remain reasonable and its operation can be adapted according to the kitchen appliance in question.

The consolidation of vapour molecules in a medium on the surface of an already existing particle is termed condensation. For example, condensation is accelerated by a drop in temperature and spraying with water. The particles may also adhere to various surfaces and thus separate from the actual group of particles, which is termed deposition. In practice, through condensation the most significant part of the mass transform from a gaseous phase to a particulate phase, even if a considerable part of the grease and especially the particles adhere to the walls of the cell too. For example, the average size of a droplet of vegetable oil is 30-100 nm.

In practice, the vapour leaving a kitchen appliance contains not only grease, but also other compounds, for example, polycyclic aromatic hydrocarbons, aromatic amines, and nitro compounds, as well as particles coming from the food. In other words, especially in connection with frying, noxious and carcinogenic compounds appear in the air. Thus a correctly operating hood and separator are very important to the health of the kitchen staff too. According to the invention, the term grease refers to the substance that arises in food making and which exits along with the exhaust air.

The use of the cell according to the invention creates effective condensation, when most of the vaporous grease emissions are separated from the exhaust air and collected in a controlled manner. This avoids the dirtying of the exhaust-air duct and the risks and costs that this leads to. In addition, the effect of the arrangement can be regulated and a suitable combination selected for each purpose. In terms of grease separation, a kitchen appliance is a difficult object, due to its heat. On the other hand, the warm exhaust air can also be exploited, provided it is first of all made sufficiently clean with the aid of the arrangement. After the cell, even a heat exchanger can be installed in the exhaust-air duct, so that the thermal energy bound to the exhaust air can be exploited, which is presently impossible.

The table on the following page shows a collection of the various phenomena that take place in the air processing, which affect the particle content and the separation of the particles in the arrangement according to the invention. Each processing process is examined separately in the case of five different phenomena. Each phenomenon is marked with a + or a – to show the effect of the processing on the phenomenon in question. If the effect on the separation of particles is favourable, the + sign is used. It can be easily seen from the table that, in addition to cooling, particularly mixing and humidification have an advantageous effect on the separation of particles. These processing processes are implemented in the arrangement according to the invention. Thanks to the cell, air can be mixed with the exhaust air, so that the temperature drops. Humidification can be used to further decrease the temperature, while simultaneously increasing the separation of the particles.

| Air processing | Nucleation = formation of particles from saturated vapour – size class 0.0004 – 1 μm | Condensation = consolidation of vapour molecules on surfaces – size class 0.08 – 2 μm | Evaporation = vapour molecules evaporated from surfaces – size class 0.08 – 2 μm | Deposition = removal of particles from particle group by striking surfaces – size class > 1 μm | Coagulation = particles collide with each other to create larger particles – size class 0.08 – 2 μm |
|---|---|---|---|---|---|
| Heating | + Increases motion especially of small particles, increasing nucleation | – Consolidation of water and grease vapour on particle surfaces reduces | + When air meets a warm surface, evaporated compounds are moved from the heater along with the airflow | – As large particles decrease, deposition on surfaces decreases | + Increases the motion especially of small particles, making coagulation more effective |
| Cooling | – Reduces the motion especially of small particles, weakening nucleation | + Consolidation of water and grease vapour on particle surfaces increases | – Evaporation insignificant | + As large particles increase, deposition on surfaces increases | – Reduces the motion especially of small particles, weakening coagulation |
| Humidification | + As number of water molecules increase, nucleation increases | + Particles grow, as water consolidates on their surface > gas phase compounds change to particle phase | – During humidification, particles grow more than compounds evaporate from their surface | + As large particles increase, deposition on surfaces increase. Wet deposition of particles with the aid of humidifier particles | + Water (particles) increase coagulation by increasing the 'particle content' |

-continued

| | | | | | |
|---|---|---|---|---|---|
| Drying | – As number of water molecules decreases, nucleation weakens | – During drying size of particles decreases more than mass is accumulated on the particles' surface | + As the air dries, water and VOC compounds evaporate from the particles' surface > new nuclei for condensation | – As large particles decrease, deposition on surfaces decreases | – Drying reduces the water-(particles) content and reduces coagulation |
| Mixing | + Mixing increases the heterogenic nucleation of water and grease vapour molecules | + Effective mixing of warm and cold air increases condensation | + Mixing increases the number of compounds evaporating from the particles' surfaces | + Mixing increases the deposition of particles on surfaces and detaches particles from surfaces | + Mixing increases the coagulation of different-size particles |
| Dilution | – Nucleation decreases as content drops and the volume flow increases | – Condensation decreases as content drops and the volume flow increases | + As the volume flow increases, evaporation from the particles' surface increases | – As condensation and coagulation decrease and evaporation increases particle size decreases and deposition decreases | – Coagulation decreases as the content decreases and the volume flow increases |
| Grease separation | + Grease and water vapour increase nucleation | + Important when removing grease vapour, mechanical separation does not succeed with the prior art | – Evaporation decreases, as impurities continually collect on the particles' surfaces | + Some of the grease particles leave the air by striking the sides of the device | + When the particles collide with each other, the grease content of the particles in the air being filtered is reduced |

The invention claimed is:

1. An arrangement in the ventilation of a kitchen appliance, which arrangement is arranged to be connected to a ventilation system including an exhaust-air duct, said arrangement comprising:

a hood which is intended to be installed above the kitchen appliance, and said hood not including any of a sensor, a damper, a water bath, and a heat exchanger;

said hood including an elongated exhaust-air connection for connecting said hood to the exhaust-air duct;

a separator for separating grease from the exhaust air;

a cell arranged after said hood limiting an area in which the vaporous grease condenses;

said cell mounting said separator at an end connected to said exhaust-air duct and having a connection at another end connected to said elongated exhaust-air connection to lead exhaust-air away from the hood;

said cell including an intake-air connection for introducing non-exhaust air into the cell to reduce the temperature of the exhaust air, for promoting the formation of droplets of vaporized grease, said cell including a temperature sensor for sensing temperature within said cell;

said arrangement also including one of a heat exchanger, a fan motor, and a damper arranged in connection with said intake-air connection for regulating the velocity, quantity, and/or temperature of the intake air, and the heat exchanger, the motor, and the damper are connected to the temperature sensor for controlling them.

2. An arrangement according to claim 1, characterized in that the cell is an elongated structure and the connection is fitted to the opposite end of the cell to the separator.

3. An arrangement according to claim 1, characterized in that the ventilation system, the cell is fitted essentially horizontally relative to its longitudinal axis.

4. An arrangement according to claim 1, characterized in that, in order to feed intake air into the exhaust air, the cell includes a distribution duct and nozzle elements connected to it.

5. An arrangement according to claim 1, characterized in that the intake-air connection is connected to the intake-air duct belonging to the ventilation system.

6. An arrangement according to claim 1, characterized in that the cell includes baffle elements for guiding the flow of the exhaust air in the cell.

7. An arrangement according to claim 1, characterized in that the cell includes washing elements for distributing washing liquid to the cell and/or the separator.

8. An arrangement according to claim 1, characterized in that the width of the cell is 1.1-2.0 times the width of the exhaust-air duct.

9. An arrangement according to claim 1, characterized in that the length of the cell is 2-6 times the width of the cell.

10. An arrangement according to claim 1, characterized in that the cubic capacity of the cell is at least 10% of the minute volume of the flow of exhaust air.

11. An arrangement according to claim 1, characterized in that the non-exhaust air is arranged to alter the flow of the exhaust air.

* * * * *